US011125519B2

(12) United States Patent
Richetti et al.

(10) Patent No.: US 11,125,519 B2
(45) Date of Patent: Sep. 21, 2021

(54) TRIGGER SHIELD APPARATUS

(71) Applicant: Richetti Tactical Solutions, LLC, Ponte Vedra Beach, FL (US)

(72) Inventors: Donald Richetti, Ponte Vedra Beach, FL (US); Ryan Richetti, Ashburn, VA (US)

(73) Assignee: RICHETTI TACTICAL SOLUTIONS, LLC, Ponte Vedra Beach, FL (US)

( * ) Notice: Subject to any disclaimer, the term of this patent is extended or adjusted under 35 U.S.C. 154(b) by 0 days.

(21) Appl. No.: 16/503,682

(22) Filed: Jul. 5, 2019

(65) Prior Publication Data

US 2019/0346225 A1 Nov. 14, 2019

Related U.S. Application Data

(63) Continuation of application No. 15/917,615, filed on Mar. 10, 2018, now Pat. No. 10,514,221, which is a continuation-in-part of application No. 15/686,135, filed on Aug. 24, 2017, now Pat. No. 9,958,225.

(60) Provisional application No. 62/450,585, filed on Jan. 26, 2017.

(51) Int. Cl.

| | |
|---|---|
| ***F41A 17/06*** | (2006.01) |
| ***F41A 17/54*** | (2006.01) |
| *B05B 12/00* | (2018.01) |

(52) U.S. Cl.

CPC ..... *F41A 17/06* (2013.01); *F41A 17/063* (2013.01); *F41A 17/54* (2013.01); *B05B 12/002* (2013.01)

(58) Field of Classification Search

CPC ..... F41A 17/54; F41A 17/46
USPC ..... 42/70.07, 70.01, 90
See application file for complete search history.

(56) References Cited

U.S. PATENT DOCUMENTS 9,958,225 B1 * 5/2018 Richetti ..... F41A 17/46

* cited by examiner

*Primary Examiner* — J. Woodrow Eldred
(74) *Attorney, Agent, or Firm* — Bennet K. Langlotz; Langlotz Patent & Trademark Works, LLC

(57) ABSTRACT

Shrouds for preventing unintentional engagement or initiation of triggers of trigger operated devices during handling of the trigger operated device are described.

13 Claims, 13 Drawing Sheets

900

TRIGGER SHIELD APPARATUS

Figure 1A:
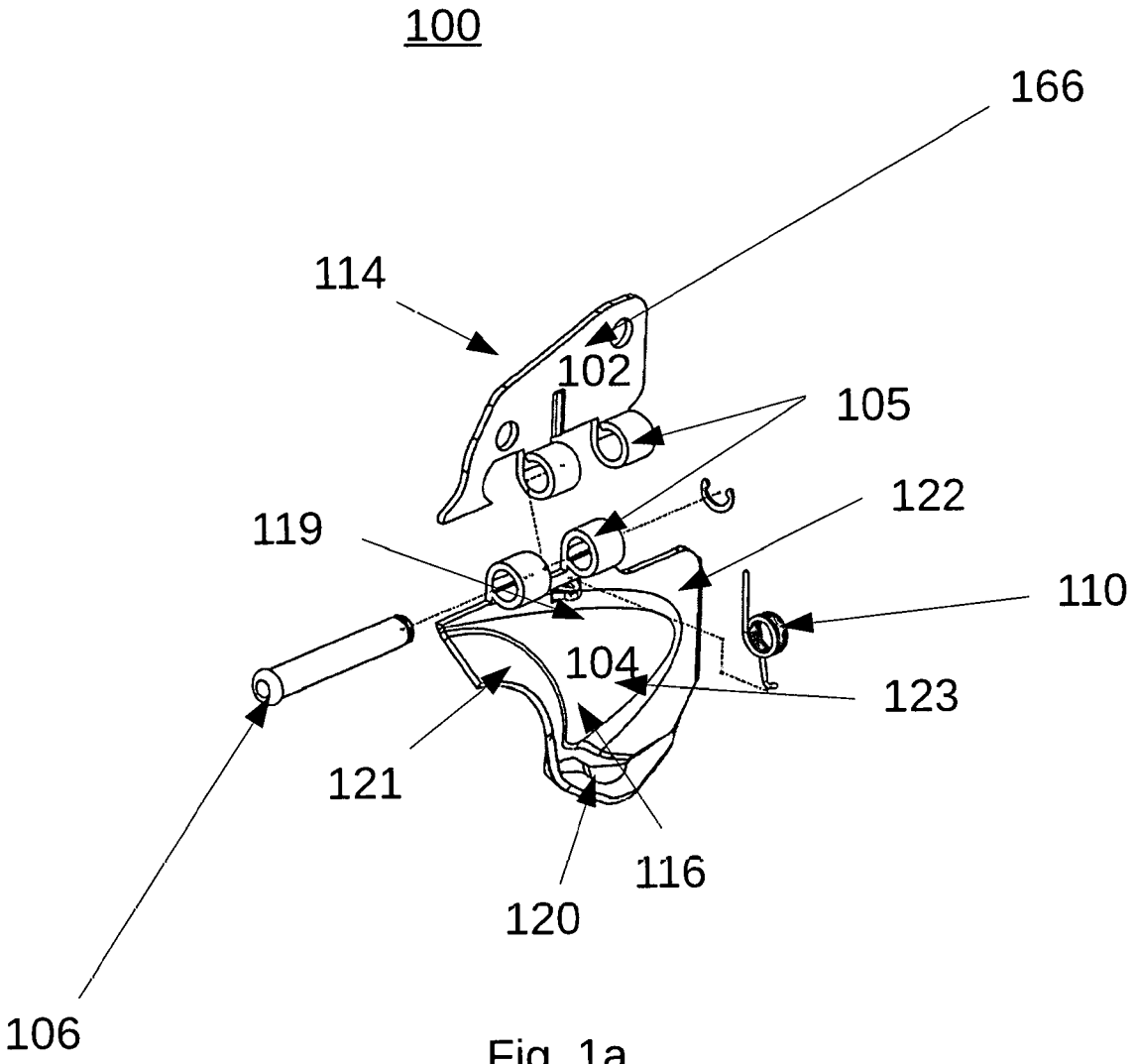

This application is a continuation application and claims priority to U.S. patent application Ser. No. 15/917,615, filed 10 Mar. 2018, which is a continuation-in-part application and claims priority to U.S. patent application Ser. No. 15/686,135, filed 24 Aug. 2017, which claims priority to U.S. Provisional Application Ser. No. 62/450,585 filed 26 Jan. 2017; all applications are incorporated herein by reference.

FIELD OF THE INVENTION

The present invention is directed to preventing unintentional engagement or initiation of firearm triggers during handling of the firearm.

BACKGROUND

Tigger locks are the typical way of blocking unintentional engagement or initiation of firearm triggers. While trigger locks perform their function well for their intended purpose, they are not a viable option for firearms that are intended to be used. When using firearms, the primary means that operators employ to avoid accidental or negligent discharges is by attention and a conscious or subconscious decision to not touch, engage or initiate a firearm trigger before executing the purposeful action of pulling the trigger. However, whether conscious or not, operators cannot devote all their attention to safety all the time. It has been identified that despite intensive training, even a firearm professional can actuate trigger accidently by having their attention redirected to other priorities.

It is recognized that any adequate rearward pressure of a trigger will precipitate the discharge of a firearm. To date, as firearm triggers have been designed and manufactured, there is no way for the inanimate trigger mechanism to intelligently determine whether or not the rearward force applied to it, resulting in discharge, was applied by; the operator's finger, someone else's finger or by any other intentional or unintentional means.

Currently, the only effective safety and security measures a firearm operator can take are training, familiarity with the firearm, focus, attention, sobriety and general appreciation for the inherent risk involved in operating a firearm.

Unfortunately, regardless of the level of training, focus, and attention, firearm accidents can still happen. By definition, an accident is the perpetration of a result or outcome without premeditation, intent or purposeful action. Even among those with years of experience, thousands of rounds fired in training or otherwise, accidental or negligent discharges of a firearm still pose a clear and present danger.

Most modern-day firearms include an external "safety" designed to impede an operator from accidentally discharging his/her firearm before purposefully meaning to do so. However, an external safety is an "actively engaged" mechanism that must be initiated by the operator to be of any value. When a firearm operator either neglects or chooses not to engage the safety, its benefit becomes null and void. Disengagement of the safety takes time, which in an immediate or anticipated live fire situation can mean the difference between life and death. Thus, in such situations, professional operators of firearms often disengage the safety prior to actively engaging a target.

With the safety disengaged, professional firearm operators are trained to use a backup safety procedure known as the "finger forward" position. Unfortunately, the finger forward position cannot always be relied upon, as it does not prevent an operator and/or ambient material (other people, gear, branch, etc.) from accessing the trigger during periods of inattentiveness or by accident.

Therefore, what is needed is a new solution by which use of firearms can be made safer without impediment to the efficiency with which they may be intentionally operated or without making them impractical to use.

FIGURES

Figure 1B:
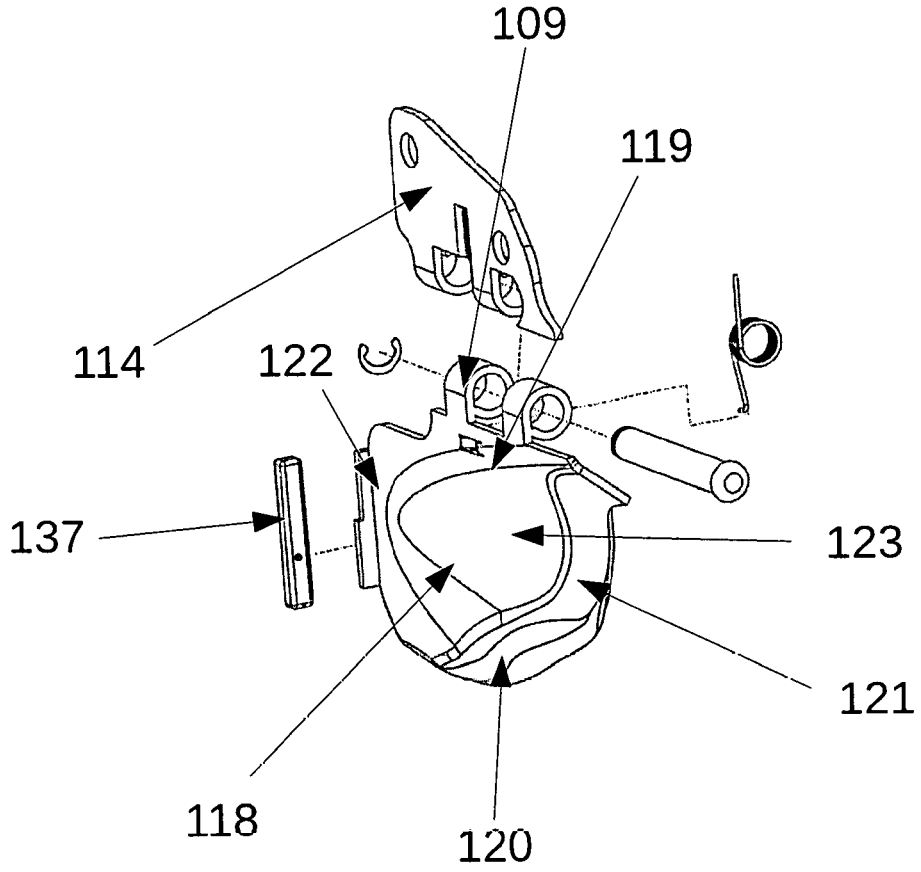

Referring now to FIGS. 1*a-b*, there is seen a front side perspective and backside perspective representation of a shroud according to the present invention.

Figure 2:
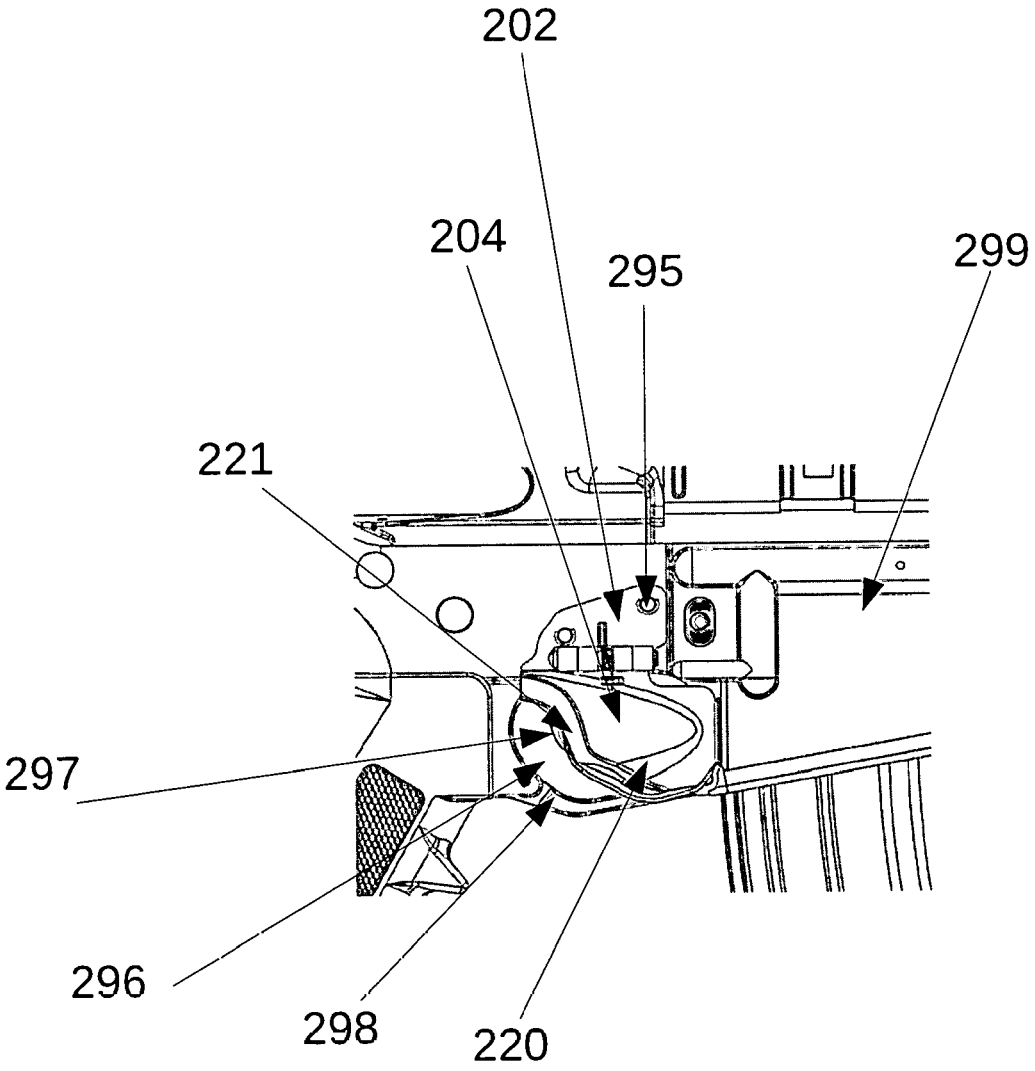

Referring to FIG. 2, there is seen a right-side view representation of a shroud mounted on a firearm and in a closed position.

Figure 3:
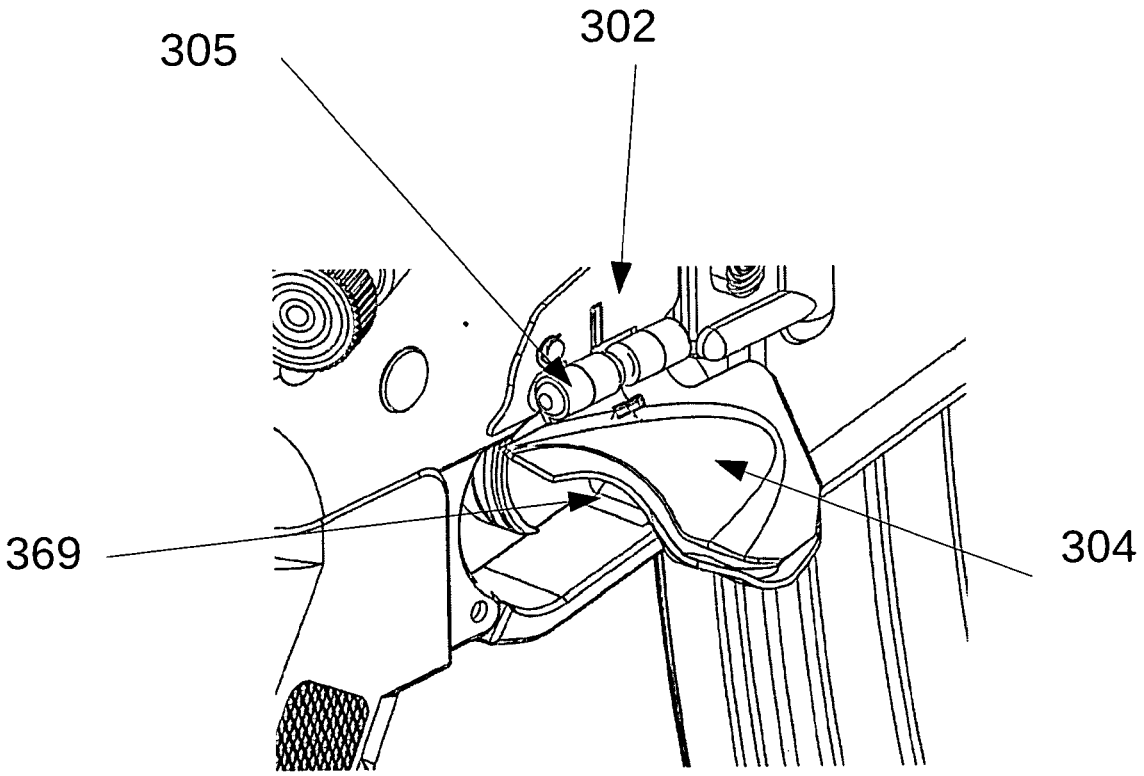

Referring to FIG. 3, there is seen a right-side view representation of a shroud mounted on a firearm and in an open position.

Figure 4A:
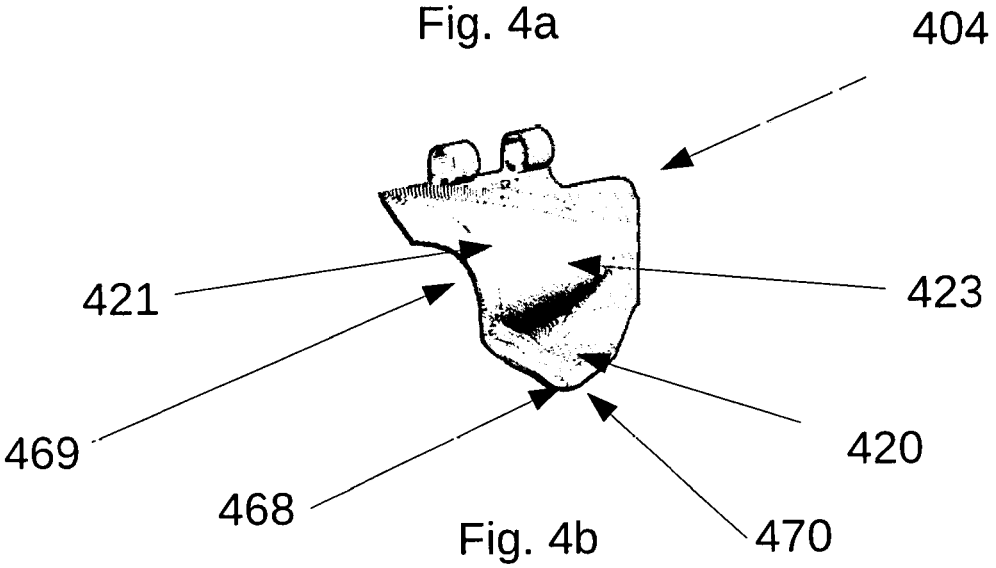
Figure 4B:
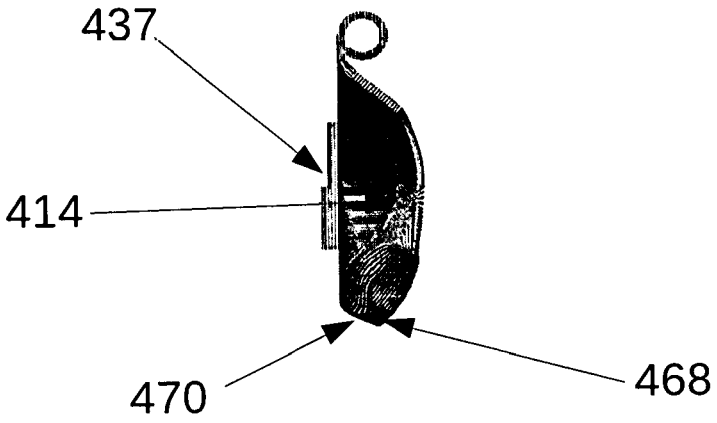
Figure 4C:
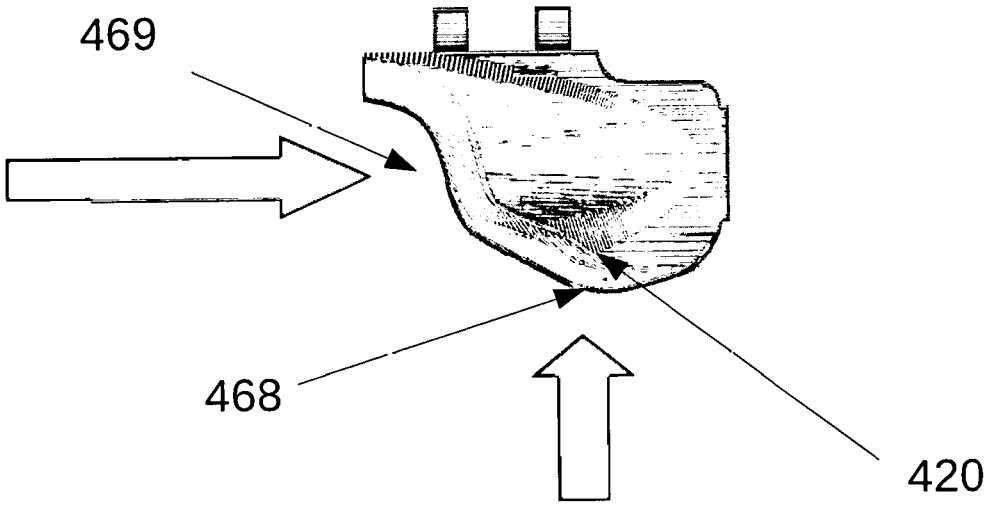

Referring to FIGS. 4*a-c*, there is seen a front perspective, side, and front representation of a finger shield.

Figure 5:
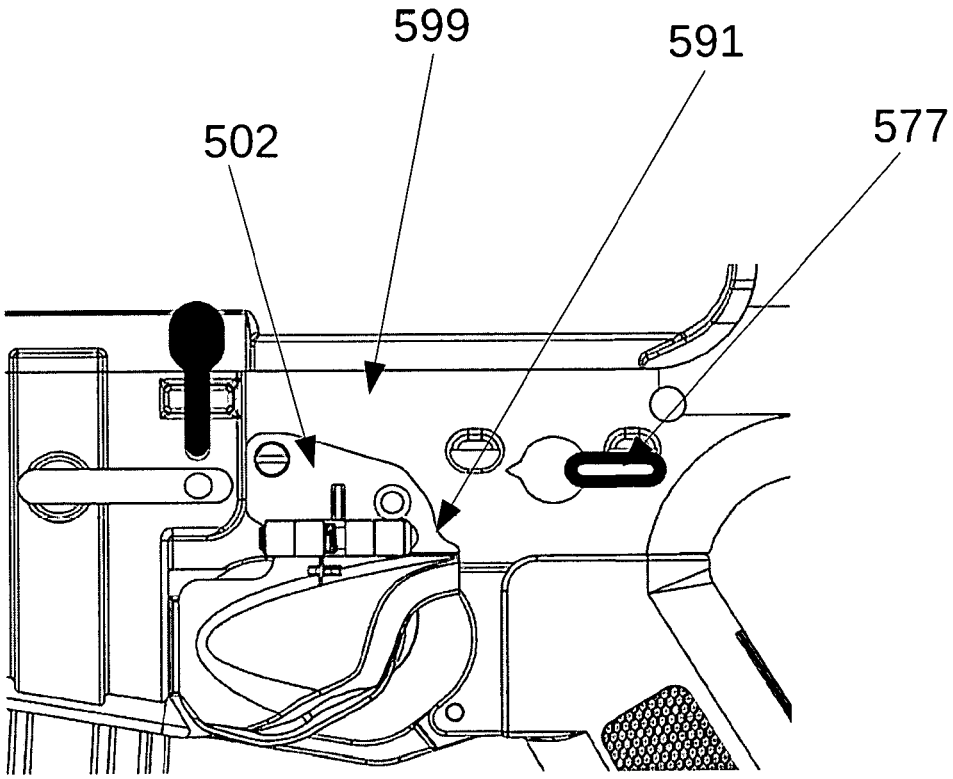

Referring to FIG. 5, there is seen a left side view representation of a second shroud mounted on a firearm and in a closed position.

Figure 6:
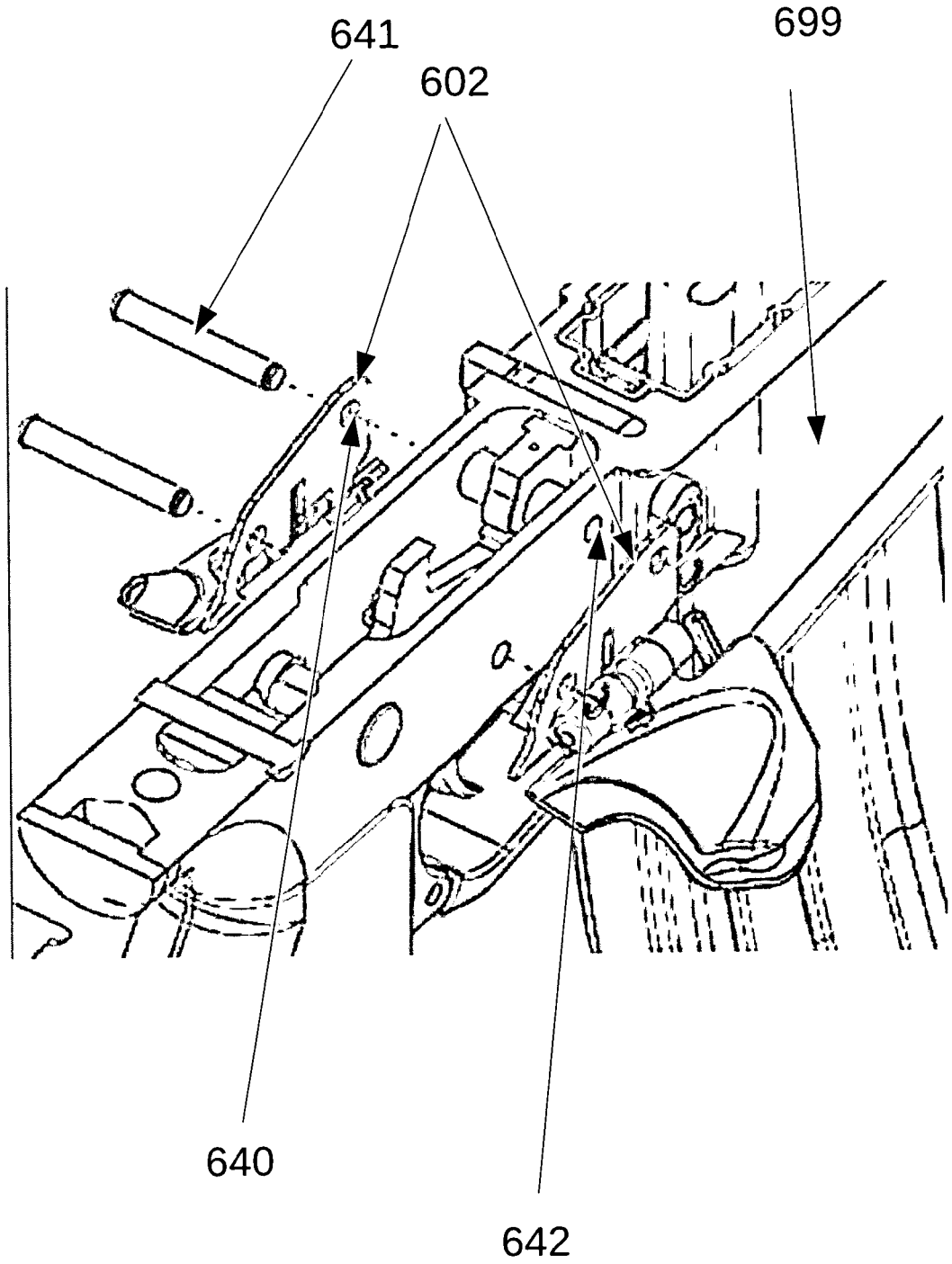

Referring to FIG. 6, there is seen an exploded perspective representation of fasteners used to secure two shrouds to a firearm.

Figure 7:
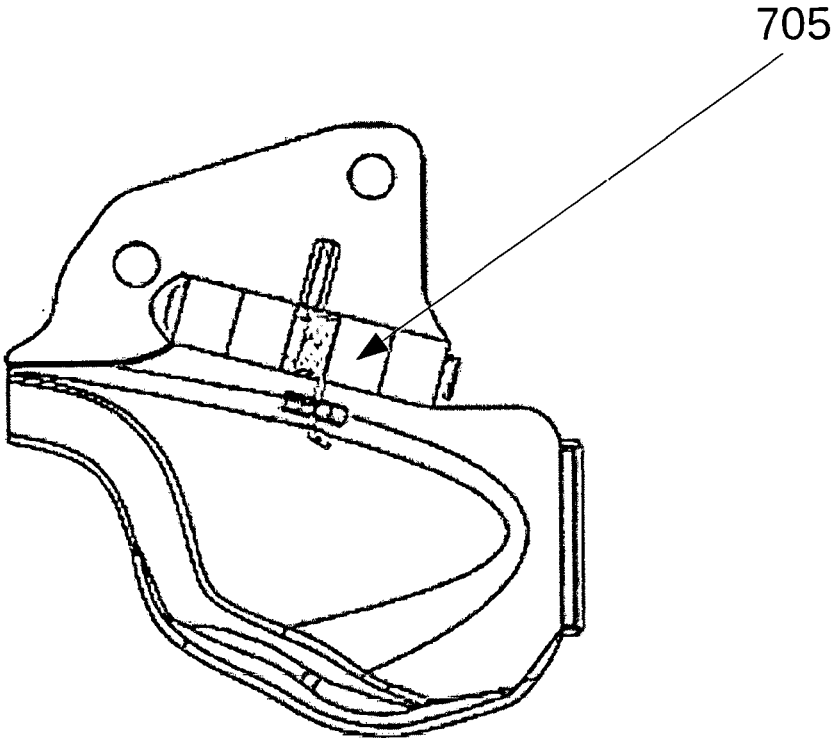
Figure 8A:
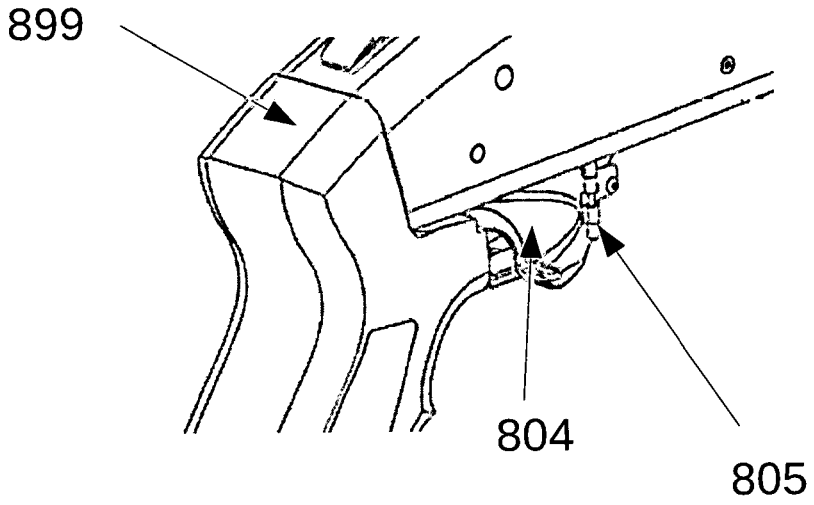
Figure 8B:
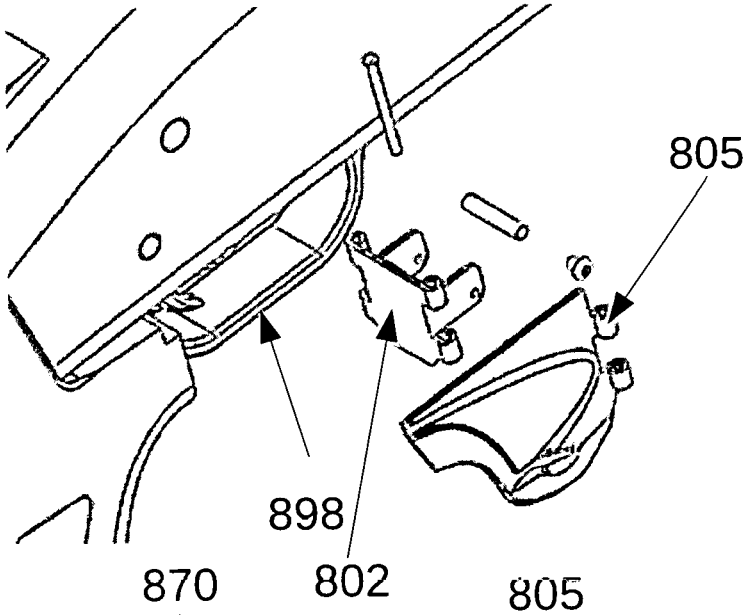
Figure 8C:
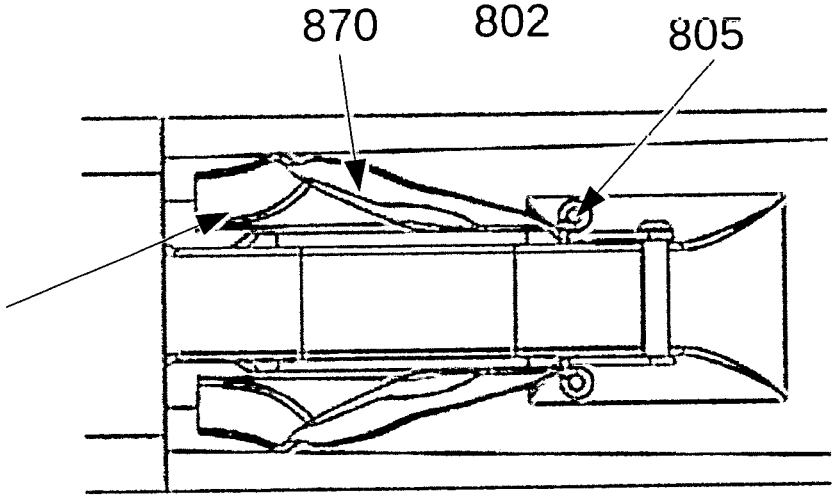

Referring to FIG. 7, there is seen a right-side view representation of a hinge orientated in a longitudinal angled orientation Referring to FIGS. 8*a-c*, there is seen a right-side view perspective, exploded, and bottom view representation of a shroud with a vertical hinge.

Figure 9A:
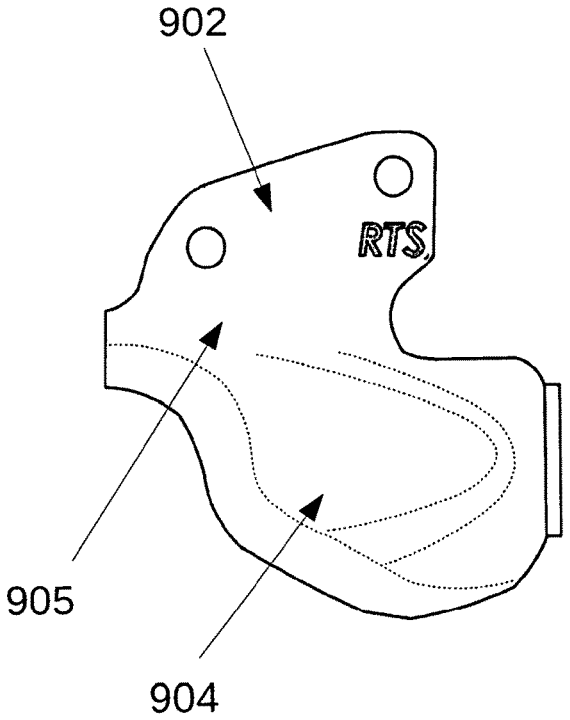
Figure 9B:
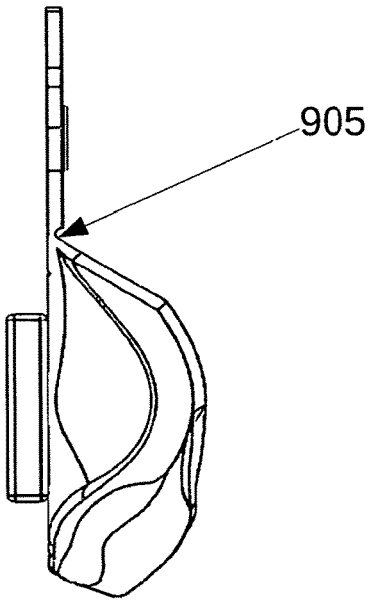

Referring to FIGS. 9*a-b*, there is seen a front and side view representation of a shroud formed to comprise a living hinge.

Figure 10A:
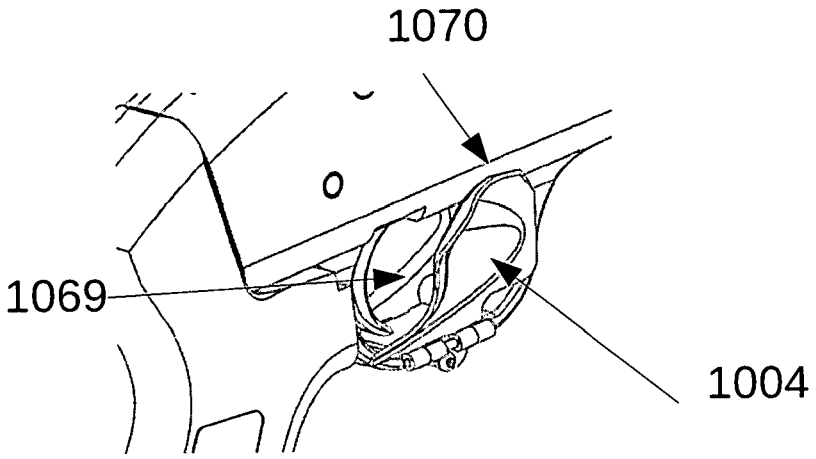
Figure 10B:
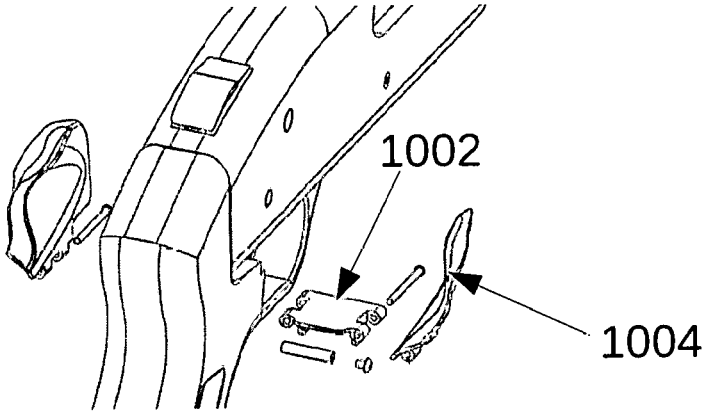

Referring to FIGS. 10*a-b*, there is seen a right-side view representation of a shroud mounted on a firearm with a second opening formed at a top of a finger shield and an exploded perspective view of the shroud for mounting to a trigger guard of a firearm.

Figure 11A:
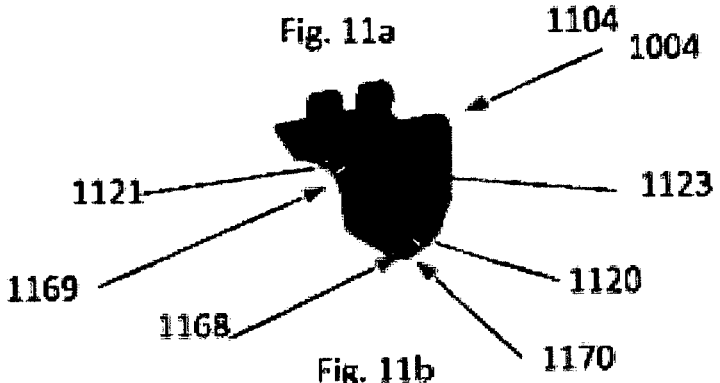
Figure 11B:
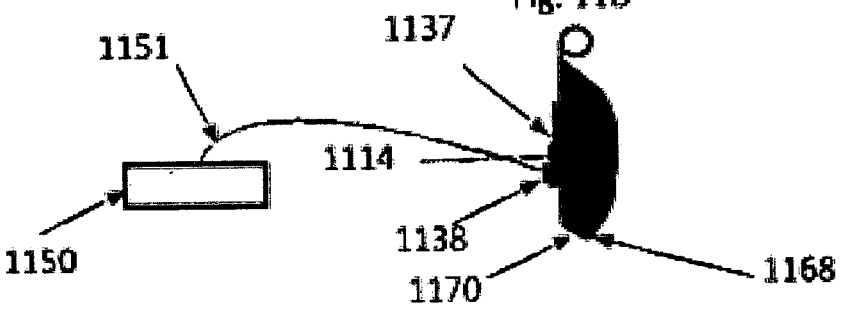
Figure 11C:
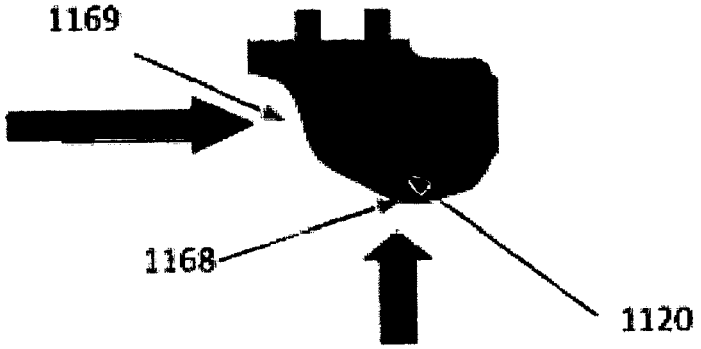

Referring to FIGS. 11*a-c*, there is seen a front perspective, side, and front representation of another embodiment of a finger shield of a shroud.

Figure 12:
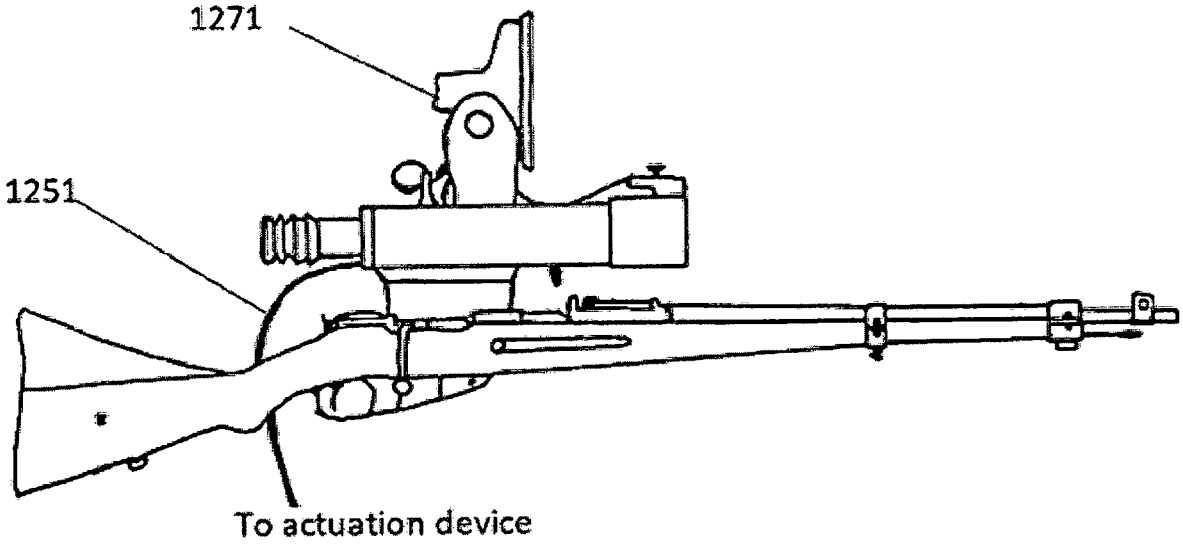

Referring to FIG. 12, there is seen a side view of at least one accessory device mounted on a trigger operated device.

SUMMARY

The present invention provides a function and level of safety and mitigation against the accidental, negligent or otherwise unintentional discharge of a firearm that, once properly applied to the weapon, executes its function without requiring action by an operator. The present invention is designed to provide its intended benefit of inherent safety at all times, except when actively bypassed.

The present invention comprises a shroud that shields a firearm trigger from inadvertent or accidental breach of the trigger well by a trigger finger or by other means. The shroud is configured to remain closed by gravity and/or downward spring pressure or to be opened by purposeful action of a firearm operator. In doing so, the present invention encumbers access to the trigger well for the purpose of preventing the trigger from being touched or pulled unintentionally, yet allows quick intentional access to the trigger when needed.

The present invention provides multiple modalities by which a trigger may be quickly accessed and yet accidental activation of the trigger is minimized. The multiple safety and protective characteristics of the present invention are relevant and not redundant because their design and utility allows for ergonomic, easy and quick purposeful access into the trigger well and onto a trigger when necessary.

The present invention does not substantially impede "quick" access to the trigger as may be necessary in a combat environment. In fact, when familiar with the function of the shroud, its deployment can shave milliseconds off an operator's reaction time compared to manually disengaging a safety when in a necessarily reactive shooting scenario.

In one embodiment, the present invention comprises: a shroud configured to prevent inadvertent or negligent insertion of an item or an operator's finger into a trigger well of a trigger operated device, the shroud comprised of: a mount; a finger shield comprised of an inner surface and an outer surface; and a hinge coupled to and disposed between the mount and the finger shield, wherein the inner and outer surface of the finger shield define a top region, a bottom region, a front region, and a rear region, wherein with the mount coupled to the trigger operated device, the inner surface of the finger shield in part defines one or more opening configured to guide a length of the person's finger into the trigger well. In one embodiment, the shroud further comprises an activation device. In one embodiment, the at least one opening is in part defined by contours formed along the inner surface of the finger shield in the rear region, or the bottom region, or the top region. In one embodiment, without insertion of a finger in the at least one opening the hinge is biased into a closed position by a biasing mechanism. In one embodiment, with the mount coupled to the trigger operated device and upon insertion of the person's finger into the at least one opening the hinge is configured to rotate about an axis. In one embodiment, with the mount coupled to trigger operated device a longitudinal axis of the hinge is parallel to a longitudinal axis of an ejector of the trigger operated device. In one embodiment, with the mount coupled to the trigger operated device a longitudinal axis of the hinge is not parallel to a longitudinal axis of an ejector of the trigger device. In one embodiment, the mount is configured with mounting apertures that correspond to apertures of the trigger operated device. In one embodiment, the actuation device comprises a mechanical or electronic switch. In one embodiment, the actuation device comprises a sensor. In one embodiment, the actuation device is configured to start, stop, activate, or deactivate an accessory device. In one embodiment, the accessory device is selected from a group consisting of a laser, a light, an IR designator, an optic device, a camera, a security device. In one embodiment, the shroud comprises: metal, Kevlar, acrylic, kydex, leather, rubber, resins, polymers, plastic, ceramic, fiber glass, and/or carbon fiber.

In one embodiment the present invention comprises: a trigger operated device, comprised of: an ejector that defines a longitudinal axis; a trigger; and a shroud comprised of: a finger shield configured to cover the trigger; a mount; and a hinge coupled to and disposed between the mount and the finger shield, wherein the finger shield is mounted to the trigger operated device by the mount, and wherein the finger shield is configured to rotate about a longitudinal axis with respect to the mount. In one embodiment, the hinge comprises a living hinge. In one embodiment, a periphery of the finger shield is contoured to in part define at least one opening within which a longitudinal length of an operator's trigger finger is capable of being inserted to cause rotation of the shroud about the longitudinal axis. In one embodiment, at least one opening comprises two different openings defined by peripheral surfaces of the finger shield that face the trigger operated device. In one embodiment, the trigger operated device comprises an assault style firearm, and wherein the mount is configured to be coupled to the assault style firearm via a pin like coupler inserted into preexisting holes of a lower receiver of the assault style firearm. In one embodiment, the trigger operated device comprises a firearm, a weapon, an RPG, a rocket launcher, an air rifle, a paintball gun, a harpoon, or a crossbow. In one embodiment, the shroud comprises an activation device configured to start, stop, activate or deactivate an accessory device mounted to the trigger operated device.

In one embodiment the present invention comprises: a shroud configured to prevent inadvertent insertion of an operator's finger into a trigger well of a firearm, the shroud comprised of: a mount; a finger shield comprised of an inner surface and an outer surface; and a hinge coupled to and disposed between the mount and the finger shield, wherein the inner and outer surfaces of the finger shield define a top region, a bottom region, a front region, and a rear region, wherein with the mount coupled to the firearm the finger shield in part defines two openings configured to guide a length of the operator's finger into the trigger well. In one embodiment the two opening are in part defined by contours formed along inner surfaces of the finger shield in the rear region and the bottom or top region. In one embodiment wherein insertion of a finger in each opening the hinge is biased into a closed position by a biasing mechanism. In one embodiment with the mount coupled to the firearm and upon insertion of the person's finger into each of the openings, the hinge is configured to rotate about an axis. In one embodiment the axis comprises a longitudinal axis, and with the mount coupled to the firearm the longitudinal axis is parallel to a barrel of the firearm. In one embodiment the axis comprises a longitudinal axis, and wherein with the mount coupled to the firearm the longitudinal axis is not parallel to the barrel. In one embodiment the shroud comprises a first and second finger shield. In one embodiment the mount is configured with mounting apertures that correspond to apertures of the firearm. In one embodiment the mount is configured to be mounted to locations on the firearm selected from the group consisting of: a stock, a frame, a grip, a handle, and a trigger guard.

In one embodiment, the present invention comprises: a shroud configured to be used by an operator of a firearm comprised of a barrel that defines a longitudinal direction, the shroud comprising: a mount; and a finger shield coupled to the mount and configured to cover at least a portion of a right or left side of the trigger well of the firearm, wherein with the shroud coupled to the firearm a periphery of the finger shield in part defines a first opening, wherein upon insertion of the operator's finger into the first opening the finger shield is configured to rotate into an open position about a longitudinal axis. In one embodiment the first opening is defined in part by an inner surface of the finger shield along a rear of the finger shield. In one embodiment a periphery of the shroud in part defines a second opening, wherein upon insertion of the operator's finger into the second opening and with the mount coupled to the firearm the finger shield is configured to rotate into an open position about the longitudinal axis. In one embodiment the shroud comprises a hinge, wherein the hinge couples the mount to the finger shield along the axis. In one embodiment the second opening is defined by a top of the periphery or the bottom of the periphery.

In one embodiment, the present invention comprises a firearm, comprised of: a barrel that defines a longitudinal direction; a trigger; a trigger well; and a shroud comprised of a finger shield that covers the trigger well, a mount, and a hinge coupled to and disposed between the mount and the finger shield, wherein the finger shield is mounted to the firearm by the mount, and wherein the finger shield is rotatable with respect to the mount about a longitudinal axis. In one embodiment the mount comprises a fastener selected from the group consisting of a pin, adhesive, solder, a magnet, a clip, a clamp, a wrap, a rail. In one embodiment the hinge comprises a living hinge. In one embodiment a periphery of the finger shield is contoured to in part define at least one opening within which a longitudinal length of an operator's trigger finger is capable of being inserted to cause rotation of the shroud about the longitudinal axis. In one embodiment the at least one opening is defined by a bottom peripheral surface of the finger shield. In embodiments the firearm comprises an M4 or AR-15 assault style firearm, and wherein the mount is configured to be coupled to the M4 or AR-15 assault style firearm via pins inserted into preexisting holes of a lower receiver of the firearm.

In one embodiment the at least one opening comprises two different openings defined by peripheral surfaces of the finger shield that face the firearm.

In one embodiment, the present invention comprises a method of mounting an accessory device to a firearm, comprising removing a securing pin from an aperture in the firearm, the securing pin having a length; replacing the one more securing pin with a securing pin having a longer length; inserting the securing pin having the longer length into the aperture; and using the longer length of the pin to secure the accessory device to the firearm. In one embodiment, the accessory device comprises a shroud comprised of a finger shield that covers a trigger of the firearm. In one embodiment, the method further comprises inserting the securing pin through the aperture in the firearm and an aperture in the accessory device. In embodiments, the firearm comprises an M4 or AR-15 assault style weapon having M4 or AR-15 style apertures.

DETAILED DESCRIPTION

Referring now to FIG. 1*a-b*, there is seen a front outside perspective and back inside perspective representation of a shroud according to an embodiment of the present invention.

In one embodiment, shroud 100 comprises a mount 102, a finger shield 104, and a hinge portion 105. Hinge portion 105 couples mount 102 to finger shield 104. Mount 102 comprises a front side 166 and a back side 114, where the back side is configured to be mounted to a firearm. Finger shield 104 comprises a front side 116, a back side 118 configured to face a trigger and trigger well of the firearm when the mount 2 is mounted to the firearm, and a periphery comprised of a top region 119, a bottom region 120, a rear region 121, a front region 122, and a middle region 123. Hinge portion 105 comprises structures 109 that enables finger shield 104 to rotationally move with respect to mount 102. In one embodiment, the structures 109 mate with each other and are held together via insertion of the one or more rod or pin 106 into apertures formed in structures 109. In one embodiment, shroud 100 also comprises a biasing mechanism 110. In one embodiment the biasing mechanism comprises a torsion spring. In one embodiment, material properties of the shroud act to bias a mounted finger shield 104 to keep it closed. In one embodiment, biasing mechanism 110 is restrained by mount 102 and delivers light downward pressure to finger shield 104 to keep the finger shield 104 in a closed position and to prevent it from flapping naturally during typical movements of the firearm, such as when carried. In one embodiment, finger shield 104 also comprises a riser 137 that is coupled to the finger shield or that is formed integrally with the finger shield.

Shroud 100 may be manufactured by machining, injection molding, stamping, cutting, 3-d printing or other manufacturing techniques known to those skilled in the art. Characteristics that can be used for selection of the material for the shroud include, but are not limited to: durability, rigidity, weight, waterproof, rustproof, and smoothness. Some materials contemplated for manufacture of the shroud 100 include, but are not limited to: metal, Kevlar, acrylic, kydex, leather, rubber, resins, polymers, plastic, ceramic, fiber glass, carbon fiber and combinations thereof. In embodiments, rod or pin 106 and biasing mechanism 110 are manufactured from a metal or other durable material capable of performing their intended function over many cycles of use.

Referring to FIG. 2, there is seen a right-side view representation of a shroud mounted on a firearm and in a closed position. Although the particular firearm 299 represented in FIG. 2 illustrates a shroud 200 mounted on the right side of an M4-style rifle, with appropriate changes in geometry and orientation, it should be appreciated that shroud 200 is capable of being configured to fit on other firearm styles including, but not limited to an AR-15 style firearm. Further, it is identified that the present invention can be used not just with assault style rifles, but other types of firearms such as, but not limited to, rifles, shotguns, pistols, handguns revolvers, etc. It is also identified that the present invention can be used in different mounting locations (see FIG. 7 below). In the orientation of FIG. 2, shroud is configured so that in a typical "finger forward" position of use, an operator's finger can comfortably rest on top of and along the bottom region 220 of the front side of finger shield 204.

Firearm 299 is representative of most firearms in that it comprises a trigger guard 298, a trigger 297, a trigger well 296, and a mounting location 295. In the case of the firearm 299 of FIG. 3, the mounting location where mount 202 of the shroud is mounted is a lower receiver. In one embodiment, when mounted to firearm 299 and when viewed from the right side of the firearm, trigger shield 204 covers at least a portion of the trigger well 296 and trigger 297. In other embodiments, a trigger shield is dimensioned to cover more or less of a trigger and/or a trigger well, for example to completely cover or block access to the trigger or trigger well. In one embodiment, when a shroud is mounted to a firearm, rear region 221 defines at least part of a first opening that is formed between trigger well 296 and the finger shield 204. In one embodiment, when a shroud according is mounted to a firearm, a bottom region 220 of the shroud defines a second opening between trigger well 296 and the finger shield. In one embodiment, the back-side surface 214 of the finger shield 204 in the rear region 221 is contoured and curved to point away from the firearm such that it in part defines the first opening. As will be seen further below, the back-side surface 214 of the finger shield 204 is also contoured and curved to in part define the second opening. In one embodiment, bottom region 220 is spaced apart from trigger guard 298 by a small distance to define the second opening. This distance allows for easier and smoother access to the trigger well by gloved or ungloved fingers.

Referring to FIG. 3, there is seen a right-side view representation of a shroud mounted on a firearm and in a partially open position. In an embodiment of use, where finger shield 304 is initially in the closed position shown in FIG. 2, and an operator's finger is held in a "finger forward" position on top and along an external contoured surface along bottom region (see 220 in FIG. 2) of the finger shield 304, it is identified that a finger's unintentional access to a trigger will be blocked, or at a minimum, hindered by the finger shield, where to achieve access to the trigger, finger shield 304 needs to be moved, for example, by rotation about hinge 305 with respect to mount 302 in a manner as represented by FIG. 3.

Referring to FIG. 4*a-c*, there is seen a front perspective, side, and front representation of a finger shield. In one embodiment, bottom region 420 of a finger shield 404 includes an outer facing lip 468 that defines a contoured and curved wall between a bottom region 420 and middle region 423. In one embodiment, an exterior of the curved wall between the bottom region and the middle 423 defines a depression that is ergonomically contoured to accept an extended operator's finger along its surface in a finger forward position. In an embodiment of use with a firearm as shown in FIG. 3, from a finger forward position, an operator can access a trigger well and trigger via a downward movement of their extended finger along the contoured surface at the bottom region 420 to below the lip 468, and then via an upward movement of the extended finger underneath the lip into a space between the lip and the trigger guard and then further into the trigger well and onto the trigger (see upward movement represented by vertical arrow in FIG. 4*c*), where after having performed the movements, finger shield 404 will be in the open position represented by FIG. 3.

The rear region 421 of the finger shield 404 is also contoured and curved to accept the operator's trigger finger via insertion under the back side along the periphery at the rear region. The curved contour defines at least part a first opening 469 under the rear region that, when mounted to a firearm, is contoured away from the firearm to accept insertion of an operator's finger via retraction of the finger backward from the finger forward position and then via forward movement into the opening 469 and along the back side 414 of finger shield 404 (see forward movement represented by horizontal arrow in FIG. 4*c*). In one embodiment, the middle region 423 of the finger shield 404 is also configured to facilitate further insertion of the finger into the trigger well. In one embodiment, middle region is defined by a countered inner and outer surface.

In one embodiment, lip 469 is held and spaced apart from a trigger well by a small distance to define at least part of a second opening 470. In one embodiment, the spacing is maintained by riser 437 that extends at a perpendicular angle to the back side 414. In one embodiment, with the finger shield 404 mounted to a firearm, the function of the riser 437 acts as a spacer that holds the finger shield 404 slightly away to create opening between the edge of the finger shield 404 and a trigger guard of the firearm it will be mounted above.

Referring to FIG. 5, there is seen a left side view representation of a second shroud mounted on a firearm and in a closed position. In one embodiment, the present invention comprises a second shroud mounted on the left side of a firearm 599. The second shroud is configured to provide same functionality as the shroud described above, but with its shape and structure adapted to function on the left side of firearm 599, see for example where periphery at 591 of a mount 502 is contoured to allow a safety 577 to be rotated between an armed, disarmed, and select fire position. In embodiments, the second shroud can be used alone or in combination with the shroud described above.

Referring to FIG. 6, there is seen an exploded perspective representation of fasteners used to secure two shrouds to a firearm. In one embodiment, each mount 602 comprises one or more aperture 640 configured to receive a fastener 641. In one embodiment, apertures 640 are formed in the mount 602 with dimensions that that enable the apertures to be aligned to preformed holes 642 of an upper receiver of firearm 699, for example, preformed holes that are used to receive pre-existing pins that hold a trigger and hammer mechanism in position on the receiver. In an embodiment of use, the pre-existing pins of the firearm are removed, one or both mounts and their apertures are aligned to the preexisting holes 642, and the pins 641 are inserted into the apertures 640 and the preformed holes 642 to hold the mounts 602 and the trigger mechanism in position.

The present invention identifies that not all firearms have conveniently formed preformed holes that can be used in the manner discussed above and contemplates that other firearms may require attachment of the present invention by other methods and in other locations on the firearm. For example, in embodiments, it is contemplated that one or both mounts 602 could be attached to a firearm via adhesive, one or more magnet, soldering, one or more clip, one or more clamp, one or more wrap, tension, or picatinny or other standardized attachment rail configuration designed to accept attachment and removal. Further, with appropriate modification made to mount 602, it is contemplated that one or both shrouds could be mounted on firearms in other orientations and other locations near or next to the trigger, for example, a stock, a frame, a grip, a handle, or a trigger guard (see FIG. 8).

Whether used with one or two shrouds, the present invention identifies that in the event that debris become lodged in a trigger well of firearm 699, the debris can easily be removed by lifting at least one shroud and pushing the debris out of the trigger well.

Referring to FIG. 7, there is seen a right-side view of a hinge orientated in a longitudinal angled orientation. With reference to FIG. 2 above, there is seen that hinge 205 defines an axis about which finger shield 204 rotates with respect to the mount 202. In the embodiment of FIG. 2, it is identified that an axis about which finger shield rotates will be generally parallel to a barrel of the firearm 299. In another embodiment, it is identified that hinge 705 may be oriented in an orientation other than parallel to that of a barrel of a firearm, for example at an angle as represented in FIG. 7. It is identified that non-parallel hinge orientations may be required by a particular firearm geometry or may be preferred by some operators that have particular hand or finger geometries unable to accommodate a parallel orientation.

Referring to FIGS. 8*a-c*, there is seen a right-side view perspective, exploded, and bottom representations of a shroud with a vertical hinge. In one embodiment, a shroud is configured for mounting to a firearm with a hinge 805 in an orientation other than parallel to a barrel of a firearm, for example, with an orientation that enables rotation about an axis that is longitudinal but not parallel to a barrel. In one embodiment, hinge 805 is oriented to rotate about a generally vertical axis relative to a barrel of a firearm 899. In one embodiment as seen in FIGS. 8*a-b*, a mount 802 of shroud is configured to be coupled to and against a trigger guard 898. With reference to the bottom view in FIG. 8*c*, when mounted to the firearm 899, inner surfaces of finger shield 804 define a first opening 869 and a second opening 870 as discussed in other embodiments above.

Referring to FIGS. 9*a-b*, there is seen a front and side view representation of a shroud formed to comprise a living hinge. With reference to the shroud described in FIG. 1 above, a hinge 105 was described to comprise structures 109, pin 106, apertures 124, and a biasing mechanism 110. With reference to FIGS. 9*a-b*, in one embodiment a shroud 900 is formed from one piece of material, and comprises a mount portion 902, a finger shield portion 904 and a hinge portion 905 disposed therebetween. In one embodiment, hinge portion 905 comprises a thinned region formed in shroud 900, where the thinned region is configured to act as a "living hinge". In an exemplary embodiment, where shroud 900 is manufactured of a flexible material, for example, plastic or leather, hinge portion 905 enables flexure to enable rotation of finger shield portion 904 about the hinge with respect to mount portion 902. With appropriate thinning and selection of material, the living hinge can provide rotation about its axis while at the same time, by virtue of at least some inherent stiffness in the material, self-biasing of the finger shield 904 of the shroud to keep it in a normally closed position.

Referring now to FIGS. 10*a-b*, there is seen a right-side view representation of a shroud mounting on a firearm with a second opening formed at a top of a finger shield and an exploded perspective view of the shroud for mounting to a trigger guard of a firearm. With reference to the previous embodiments discussed above, a shroud has been described with reference insertion of a finger under the shroud at a bottom and/or at a rear of the shroud. FIGS. 10*a-b* show another embodiment, where a shroud is configured to accept insertion of a finger at a rear of the shroud into a first opening 1069 and/or at the top into a second opening 1070. As seen in FIG. 10*b*, in one embodiment, mount portion 1002 of the shroud is configured to be mounted to a trigger guard.

Although the embodiments above have been described with reference to trigger operated firearms, the present invention contemplates use of shrouds with other types of trigger operated devices, such as, but not limited to: gas powered rifles, gas powered pistols, paintball guns, toy guns, and blue training guns. In some embodiments, it is further contemplated that trigger operated devices do not necessarily comprise barrels, instead being comprised of trigger actuated ejectors configured to eject projectiles along a longitudinal ejection axis, for example, an ejection axis as is defined by harpoons or crossbows.

Referring to FIGS. 11*a-c*, there is seen a front perspective, side, and front representation of another embodiment of a finger shield of a shroud. In one embodiment, finger shield 1104 is configured and used generally in the same manner as described with reference to the finger shield 404 of FIGS. 4*a-d*. However, in the embodiment of FIGS. 11*a-c*, finger shield 1104 additionally comprises and/or acts as an actuation device that is configured to activate/start, or deactivate/stop an accessory device.

In one embodiment, finger shield 1104 comprises an actuation device 1138 configured to be activated when a user interacts with the finger shield 1104. In one embodiment, actuation device 1138 is attached to finger shield 1104. In one embodiment, actuation device 1138 is integrated into finger shield 1104. In one embodiment, actuation device 1138 is attached to or integrated into riser 1137. In one embodiment, a user's finger press against the outside of finger shield 1104 causes the shield and therefore riser 1137 to move toward the trigger operated device it is mounted on. In one embodiment, a user's finger press against bottom region 1120 of finger shield 1104 causes the shield and therefore riser 1137 to move toward the trigger operated device it is mounted on. In one embodiment, movement of the finger shield toward the trigger operated device causes actuation device 1138 to activate an accessory device 1150 by completing an electrical circuit 1151 between the accessory device and the actuation device. In one embodiment, actuation device 1138 comprises a switch. In one embodiment, actuation device 1138 comprises a pushbutton switch with electrical contacts that are normally open. In one embodiment, completion of electrical circuit 1151 is achieved via biasing of normally open electrical contacts of actuation device 1138 to a closed position. In one embodiment, movement of finger shield 1104 toward a trigger operated device the finger shield is mounted on causes normally open contacts of actuation device 1138 to close, which in turn completes electrical circuit 1151, and subsequent movement away causes the closed contacts to open.

In one embodiment, consecutive movement of finger shield 1104 toward a trigger operated device is required to consecutively close and then open electrical circuit 1151. Non limiting accessory devices contemplated by the present invention include: a battery, a laser, a light, a camera, an IR designator, and/or an optic device. In another embodiment, opening of electrical circuit 1151 by an actuation device deactivates an accessory device. In another embodiment, opening of electrical circuit 1151 by an actuation device activates an accessory device. In another embodiment, closing of electrical circuit by an actuation device deactivates an accessory device. In one embodiment, electrical circuit 1151 is comprised of two wires (power and ground), where actuation device 1138 completes an electrical connection between the two wires. In another embodiment, electrical circuit 1151 comprises only one wire, where actuation device 1138 completes an electrical connection along the one wire between the actuation device and an accessory device, and where a ground return is provided by metal to metal contact between the actuation device 1138, a shroud, a trigger operated device, and an accessory device mounted to the trigger operated device.

In another embodiment, rather than couple or integrate an actuation device to, or on, finger shield 1104, it is contemplated that the actuation device can be coupled to, or integrated on, a trigger operated device. In one embodiment, opening and closing of an electrical circuit by an actuation device mounted on a trigger guard is caused via movement of finger shield 1104, for example, by moving the finger shield toward the trigger guard and thus the actuation device.

In other embodiments, actuation device 1138 is comprised of a detector, for example, but not limited to: a magnetic field detector, a RF field detector, a capacitance detector, a temperature detector, where upon detection by the detector, actuation device 1138 completes or opens electrical circuit 1151. In embodiments, a presence of a user worn device (for example, magnetic ring or RFID device), or the user themselves (for example, via changes in capacitance caused by the user's finger or body) is detected by an actuation device mounted on a trigger shield or a trigger operated device, which detection can be used to cause opening or closing of an electrical circuit of the actuation device.

As described above, an actuation device can be used to activate or deactivate an accessory device via detection of a user or user worn device. In another embodiment, actuation device 1138 is embodied as an accessory device. In one embodiment, actuation device 1138 comprises a security device configured to prevent unauthorized access to a trigger of a trigger operated device. In one embodiment, actuation device 1138 comprises a magnetic device configured to keep finger shield 1104 secured to a trigger operated device until the magnetic device is deactivated. In embodiments, actuation device 1138 comprises a magnet or an electro-magnet powered by a power circuit of the actuation device, which when mounted to a trigger operated device magnetically attracts a magnetic portion of the finger shield, or attracts a magnet on the finger shield, to the actuation device, or when mounted on the finger shield causes the finger shield to be attracted to a trigger operated device or magnet attached to the trigger operated device. In one embodiment, movement of finger shield 1104 and, thus, access to trigger by a user, is prevented until actuation device 1138 is deactivated, for example, by positioning a finger or body worn deactivation device in the vicinity of the actuation device. In one embodiment, actuation device 1138 is configured to sense only specific deactivation devices and not others, for example, via embedded codes or signals incorporated into the deactivation devices. In one embodiment, actuation device 1138 is configured such that a deactivation device comprised of a magnetic or RFID device in its presence causes release of finger shield via opening of a power circuit of the actuation device. In another embodiment, a deactivation device comprises a magnetic or RFID device that is configured to cause a magnetic or RFID field generated by actuation device 1138 to be disturbed in a manner that allows release of finger shield 1104. In another embodiment, actuation device 1138 comprises a solenoid configured to prevent movement of finger shield 1104 in an unpowered state, for example, via an interfering fit of a solenoid plunger with a portion of the finger shield. In one embodiment, when a user or body worn deactivation device is placed near actuation device 1138, the actuation device is activated to complete a power circuit to the solenoid, the interference fit is removed, which allows finger shield 1104 to move and accept a user's trigger finger.

Referring to FIG. 12, there is seen a side view of at least one accessory device mounted on a trigger operated device. In one embodiment, an accessory device 1271 is coupled to an actuation device by via an electrical circuit 1251 as discussed above. Although in FIG. 12 accessory devices are shown mounted to the top of a portion of trigger operated device, it is understood that in other embodiments, trigger operated devices can be mounted below or on sides of portions of the trigger operated devices.

The present invention and its various embodiments, benefits, and advantages are understood to be representative and should be limited only by the metes and bounds of the following claims.

The invention claimed is:

1. A shroud for a trigger operated device having a trigger well, the shroud comprising:

a mount portion;

a finger shield movably connected to the mount portion for movement between a first position in which the shield is proximate the trigger well to prevent inadvertent access, and a second position in which the finger shield is away from the trigger well to enable access;

the finger shield having an access contour proximate the device when the finger shield is in the first position to enable entry of a user's finger into the access contour to move the finger shield to the second position and enable access to the trigger well;

the finger shield being movably connected to pivot about a pivot axis oriented parallel to a bore axis of the trigger operated device; and the finger shield being biased in a downward direction.

2. The shroud of claim 1, wherein the shroud further comprises an activation device.

3. The shroud of claim 2, wherein the access contour is in part defined by contours formed along an inner surface of the finger shield in a rear region, a bottom region, and/or a top region.

4. The shroud of claim 3, wherein without insertion of a finger into the access contour, a hinge is biased into a closed position by a biasing mechanism.

5. The shroud of claim 3, wherein with the mount portion coupled to the trigger operated device and upon insertion of the person's finger into the access contour, the hinge is configured to rotate about an axis.

6. The shroud of claim 1, wherein with the mount portion coupled to the trigger operated device, a longitudinal axis of a hinge is parallel to a longitudinal axis of an ejector of the trigger operated device.

7. The shroud of claim 1, wherein with the mount portion coupled to the trigger operated device, a longitudinal axis of a hinge is not parallel to a longitudinal axis of an ejector of the trigger device.

8. The shroud of claim 1, wherein the mount portion is configured with mounting apertures that correspond to apertures of the trigger operated device.

9. The shroud of claim 2, wherein the actuation device comprises a mechanical or electronic switch.

10. The shroud of claim 2, wherein the actuation device comprises a sensor.

11. The shroud of claim 2, wherein the actuation device is configured to start, stop, activate, or deactivate an accessory device.

12. The shroud of claim 11, wherein the accessory device is selected from a group consisting of a laser, a light, an IR designator, a scope, a camera, and a security device.

13. The shroud of claim 1, wherein the shroud comprises: metal, aramid fiber, acrylic, acrylic-polyvinyl chloride composite, leather, rubber, resins, polymers, plastic, ceramic, fiber glass, and/or carbon fiber.

* * * * *